US006666799B2

(12) United States Patent
Hildebrandt et al.

(10) Patent No.: US 6,666,799 B2
(45) Date of Patent: Dec. 23, 2003

(54) RECUMBENT TOTAL BODY EXERCISER

(75) Inventors: Mark D. Hildebrandt, Ann Arbor, MI (US); Todd A. Sutton, Grand Rapids, MI (US); Steve W. Sarns, Dexter, MI (US)

(73) Assignee: Nustep, Inc., Ann Arbor, MI (US)

( * ) Notice: Subject to any disclaimer, the term of this patent is extended or adjusted under 35 U.S.C. 154(b) by 0 days.

(21) Appl. No.: 10/078,681

(22) Filed: Feb. 19, 2002

(65) Prior Publication Data

US 2002/0151415 A1 Oct. 17, 2002

Related U.S. Application Data

(62) Division of application No. 09/492,556, filed on Jan. 27, 2000, now Pat. No. 6,361,479, which is a division of application No. 09/162,607, filed on Sep. 29, 1998, now Pat. No. 6,042,518.

(51) Int. Cl.[7] ..... A63B 69/16
(52) U.S. Cl. ..... 482/57; 482/908
(58) Field of Search ..... 482/51, 57–65, 482/908, 148; 248/349.1, 424–25, 429, 430; 297/244.22, 331–336

(56) References Cited

U.S. PATENT DOCUMENTS

| | | | | | |
|---|---|---|---|---|---|
| 3,113,804 | A | * | 12/1963 | Ritter | 297/252 |
| 4,570,997 | A | * | 2/1986 | Tanizaki et al. | 297/344.24 |
| 4,768,775 | A | * | 9/1988 | Marshall | 272/72 |
| 4,840,426 | A | * | 6/1989 | Vogtherr et al. | 297/300 |
| 5,082,328 | A | * | 1/1992 | Garelick | 297/344.1 |
| 5,209,223 | A | * | 5/1993 | McGorry et al. | 601/34 |
| 5,702,084 | A | * | 12/1997 | Carnahan et al. | 248/416 |
| 5,890,764 | A | * | 4/1999 | Lee | 297/344.22 |
| 6,088,847 | A | * | 7/2000 | Burrow | 4/579 |

* cited by examiner

*Primary Examiner*—Danton D. DeMille
*Assistant Examiner*—Tam Nguyen
(74) *Attorney, Agent, or Firm*—Brinks Hofer Gilson & Lione

(57) ABSTRACT

A recumbent apparatus for exercise and physical therapy providing a lower body workout, an upper body workout and cardiovascular conditioning, the apparatus comprising a frame having a forward end and a rearward end, the frame generally defining a longitudinal axis extending between the forward and rearward ends, a seat supported by the frame, a left leg assembly and a right leg assembly, the leg assemblies supported by the frame for pivoting movement about a pivot axis transverse to the longitudinal axis, the leg assemblies positioned generally toward the forward end and each including an upwardly extending leg lever terminating in a pedal, a left arm assembly and a right arm assembly, the arm assemblies supported by the frame for pivoting movement also about the pivot axis, the arm assemblies positioned generally toward the forward end and each including an upwardly extending arm lever terminating in a handle, the left leg assembly being connected to the right arm assembly enabling movement therewith and defining a first connected assembly, the right leg assembly being connected to the left arm assembly enabling movement therewith and defining a second connected assembly, the connected assemblies coupled by at least one generally stiff mechanical linkage to a cam such that forward movement in one of the connected assemblies induces rearward movement in the other the connected assemblies, thereby enabling contralateral movement of the arm and leg assemblies, a first belt coupled to the cam and a first one way clutch, wherein the cam is actuated by the stiff mechanical linkage in a first direction and the first belt is actuated by the cam, the first belt rotating the first one way clutch, a second belt coupled to the cam and a second one way clutch, wherein the cam is actuated by the stiff mechanical linkage in a second direction and the second belt is actuated by the cam, the second belt rotating the second one way clutch, the first and second one way clutches coupled with a pulley which is further coupled to a resistance device by a third belt, the resistance device providing resistance to the movement of the arm and leg assemblies about the pivoting axis.

12 Claims, 8 Drawing Sheets

Figure - 8
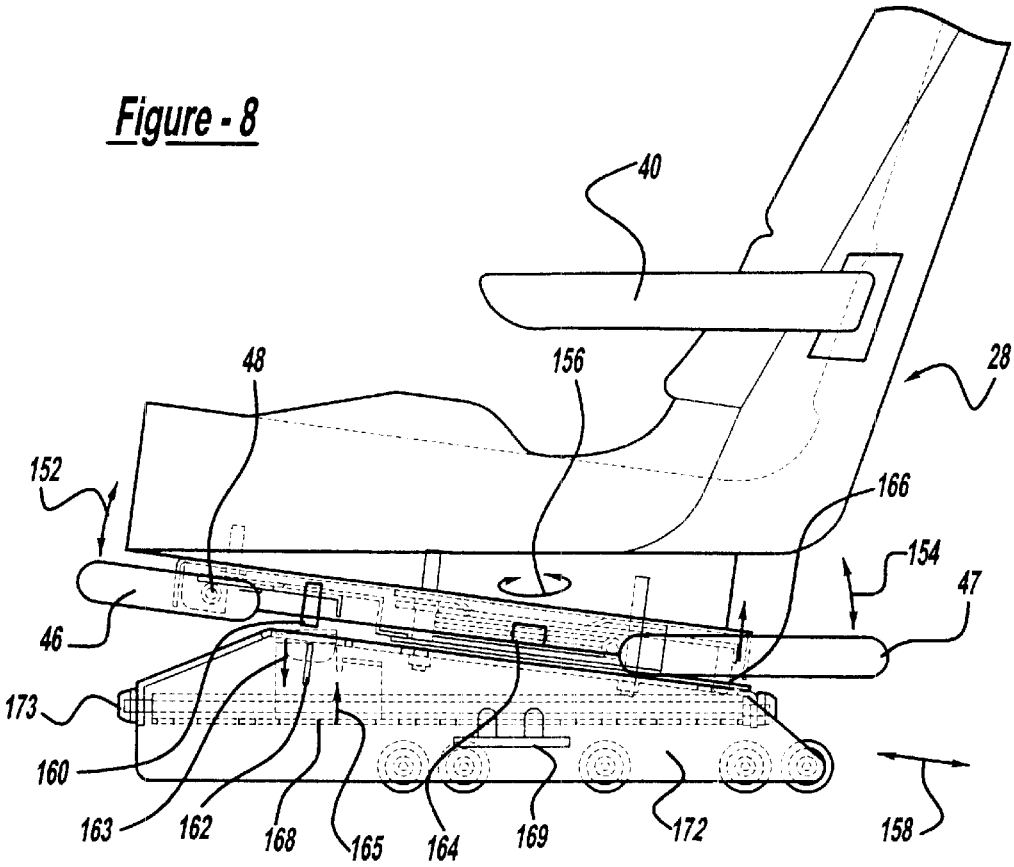
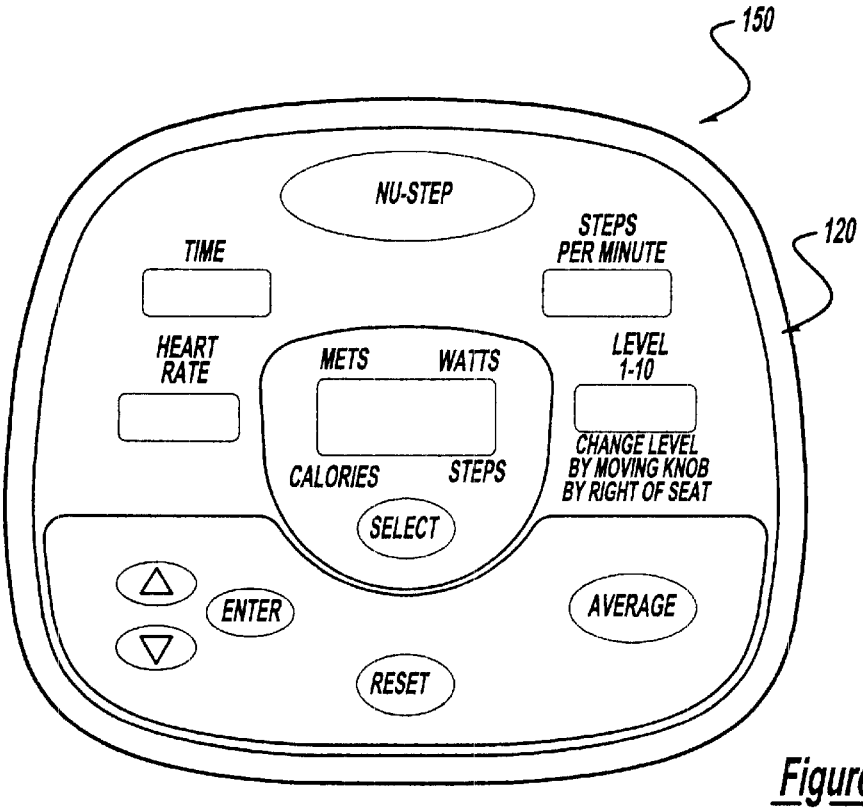
Figure - 9

RECUMBENT TOTAL BODY EXERCISER

CROSS REFERENCE TO CO-PENDING APPLICATION

This application is a divisional application of Ser. No. 09/492,556, filed Jan. 27, 2000, now U.S. Pat. No. 6,361,479 allowed on Jan. 16, 2002, which is a divisional application of Ser. No. 09/162,607, filed Sep. 29, 1998, now U.S. Pat. No. 6,042,518, issued on Mar. 28, 2000.

BACKGROUND OF THE INVENTION

The present invention generally relates to equipment for physical therapy and/or general exercise. More particularly, this invention relates to a recumbent exercise machine which provides for the exercising and strengthening of major muscle groups in addition to cardiovascular conditioning. In so doing, the present invention includes lower body exercises coordinated with upper body exercising.

Elderly patients, patients undergoing physical therapy, and other patients in similar circumstances, whether at home, in the hospital or in another clinical setting, have special needs when it comes to physical therapy equipment. Often, the patients have limited mobility, age related illnesses, decreased ranges of appendage movement, disabilities, low endurance and need for therapy with respect to more than one particular movement or muscle group. All of these factors must be taken into consideration when designing or providing equipment for their use.

Those people who exercise for its many health benefits, and not specifically for rehabilitation purposes, typically desire equipment which is challenging, safe, fun, effective, convenient and which provides a benefit to a multiple number of muscle groups so that a total body workout is achieved in a relatively short period of time. When the equipment is for home use, other important considerations include durability and cost.

Numerous types and varieties of physical therapy and exercise equipment are available for both clinical and home use. Of the many types, two of the most popular include the stepping machines (hereinafter "steppers") and the stationary bicycles. Each of these machines, however, has certain limitations concerning their ease of use, range of movement, safety, and the muscle groups worked.

Generally steppers include a pair of pedals which move up and down, thereby simulating the climbing of steps, in response to the weight and physical effort of the patient or exerciser (hereinafter "user"). The pedals are connected to a mechanism which applies a resistance or load. This resistance is often adjustable so that the stepper can accommodate users of various levels of physical conditioning and ability.

One limitation of steppers is that the user is typically required to stand during the exercise. Since the user is in an upright position, a significant amount of balance and coordination on the part of the user is required. Because of the decreased mobility and coordination, this may prevent a patient undergoing physical therapy from using the stepper. A related limitation of the stepper is that it requires continuous close supervision when being used by a person undergoing physical rehabilitation. Close supervision by a physical therapist or assistant is required to ensure that the patient does not collapse or otherwise lose balance and fall from the stepper, resulting in an injury. A further limitation of the stepper is its lack of exercise or conditioning of the upper body of the user. Finally, steppers may elevate the heart rate and the blood pressure too quickly for unconditioned and elderly patients, potentially causing harm.

One limitation of a stationary bicycle is that the seat is a typically narrow saddle seat positioned above a pair of rotatable pedals having a fixed range of motion. The rotation of the pedals is resisted by a brake or other resistance mechanism. The user is required to lean forward to hold onto a set of handles, which maybe stationary or movable. In order to use a stationary bicycle, the user must be capable of climbing up onto the seat and must possess sufficient strength, balance, and coordination to maintain themselves on the narrow seat while pedaling over a fixed range of motion and manipulating the handles if they are of the movable variety. Often the elderly, overweight or physical therapy patient cannot use a stationary bike because of the above requirements and further because they require constant supervision by the physical therapist to prevent possible injury to the patient upon collapse or loss of balance.

As can be seen from the above discussion, there is the need for an apparatus which allows the user to easily get on and off the apparatus with or without assistance. Furthermore, the apparatus should provide a high degree of stability and safety to the user so that the user can manipulate the machine without constant attention or supervision. Additionally, the apparatus should be adjustable to accommodate users of significantly different sizes and physical conditions while still being comfortable.

The application of resistance during the use of an exercise machine is also very important. Many exercise machines today have resistance systems which offer nonuniform or variable resistance. Chains and cables used by present exercise machines create this nonuniform resistance. The chains and cables, because of their flexible nature, do not provide solid linkages to a resistance apparatus and may have instantaneous transitions between little resistance and full resistance. The elderly or disabled prefer a smooth consistent resistance throughout their exercise movements. The variable or jerking motions that sometimes occur with resistance devices using chains and cables could potentially cause injury to an elderly or disabled person.

The use of constant resistance in present exercise machines such as steppers is also difficult because of the arcuate or curved nature of their exercise motions. The arcuate movement by its very nature varies the mechanical lever created by the exerciser and machine. This variation in lever position will vary the amount of force exerted upon a linkage and thus the resistance felt by the exerciser.

Magnetic resistance devices are known in the art to provide smooth maintenance free resistance for exercise machines. Magnetic resistance devices vary the resistance of an exercise machine through the interaction of a magnetic field from a magnet or array of magnets generating eddy currents in a material. The strength of the interaction is a function of the amount of magnetic flux interacting with the material, the greater the amount of magnetic flux interaction the stronger the magnetic force. This relationship can be used to vary the resistance on a spinning wheel of the kind used in exercise machines. Present magnetic resistance devices use arrays of magnets that rotate about a pivot point to vary the resistance in an exercise machine. These present magnetic resistance devices do not include predictable fixed linear positioning systems which allow proportional step adjustments in the resistance.

There is also a need to provide a safe and easy way to exit and dismount an exercise machine. Recumbent seat exercisers today are usually mounted by stepping over the seat and sitting down. This leads to a potentially dangerous situation if the user becomes unbalanced and falls. There is a need for an improved method of mounting an exercise machine.

SUMMARY OF THE INVENTION

The exerciser of the present invention utilizes a recumbent seat which is horizontally displaced from pedals and arm assemblies. The seat itself is a full bucket style seat, including a seat cushion in a seat back, positioned at a normal chair height. This provides a safe, stable, and familiar seating position for the user. When used during physical therapy, the patient can use the apparatus with only moderate supervision, thereby freeing the physical therapist to attend to other patients or duties.

The user of the present invention is also provided with a recumbent seat mounted on a slide and pivot. The slide allows the recumbent seat to be moved back and forth to adjust for different body dimensions. The recumbent seat is positioned on a pivot so that it may rotate and allow a user to sit in the seat while the seat is perpendicular to the length of the machine, and then rotate into position to use the exercise machine. Thus a user with low mobility is not required to climb up onto the apparatus or raise a leg over a high center portion of a frame. The present invention has an added safety feature to prevent the seat from sliding while pivoting. A mechanism will lock out and prevent the seat from moving back and forth while the user pivots in and out of the machine.

Once seated, the position of the chair relative to the pedals can be adjusted, as well as the length of the handles relative to the chair, for the size of the particular user. The relationship and geometry of the chair, the pedals, the handles, and the position of the pivot for the handles and pedals is such that the movement of the user's arms and legs will be maintained in a correct biomechanical relationship or form. The maintenance of proper form ensures efficient conditioning in addition to a comfortable exercising or therapy position.

During use of the exercise apparatus, the pedals and handles undergo their coordinated movement against a constant resistance force provided by one of the variety of known resistance mechanisms. The level of resistance provided by the resistance mechanism is smooth and constant because of solid mechanism linkages provided from the arm and leg assemblies to a cam, as opposed to chains or cables. The cam is linked to a resistance device and has been configured to maintain uniform resistance throughout the stroke or movement of the exercise machine. The solid linkages combined with the cam configuration provides a smooth constant resistance favored by aged or disabled users.

As can be seen from the above discussion, there is a need for an apparatus which allows the user to easily get on and off the exercise apparatus without assistance. Furthermore, the apparatus should provide a high degree of stability and safety to the user so that the user can manipulate the machine without constant attention or supervision. Additionally, the apparatus should be adjustable to accommodate users of significantly different sizes and physical conditions while still being comfortable.

Accordingly, it is an object of the present invention to provide an apparatus which overcomes the limitations of the known prior art. In so doing, a further object of this invention is to provide a recumbent apparatus which can be easily mounted and dismounted by a user having a limited amount of mobility, with or without the assistance of another person.

The present invention also has as one of its objects providing an apparatus which uses a stepping or oscillating arcuate motion to provide a lower body workout or therapy. A further object of the invention is to provide an apparatus which uses an oscillating arcuate motion to provide an upper body workout or therapy. Another object is to maintain a smooth constant resistance to the exercise motions to prevent any variable motion or jerking that might cause injury to a user.

Another object of this invention is to provide an apparatus which is familiar to use and which simulates the coordinated arm and leg movement used during walking or running. To this end, the present invention also has one of its objects to provide upper body exercise which is contralaterally coordinated with lower body exercise.

Still another object of the present invention is to provide a physical therapy and exercise apparatus which is easy to use, has adjustable resistance levels, is durable and which is relatively inexpensive to produce.

In achieving the above objects, the present invention provides for a recumbent total body exercise apparatus. The apparatus includes pedals which undergo an oscillating or stepping motion. The pedals are contralaterally synchronized with handles that also undergo an oscillating motion, providing the user with a total body conditioning workout.

Additional benefits and advantages of the present invention will become apparent to those skilled in the art to which this invention relates from the subsequent description of the preferred embodiment and the appended claims, taken in conjunction with the accompanying drawing.

BRIEF DESCRIPTION OF THE DRAWINGS

FIG. 8 is a diagrammatic view of the seat and seat adjustment mechanisms of the present invention; and FIG. 9 is a diagrammatic view of the control system of the present invention.

DETAILED DESCRIPTION OF THE PREFERRED EMBODIMENT

Figure 1:
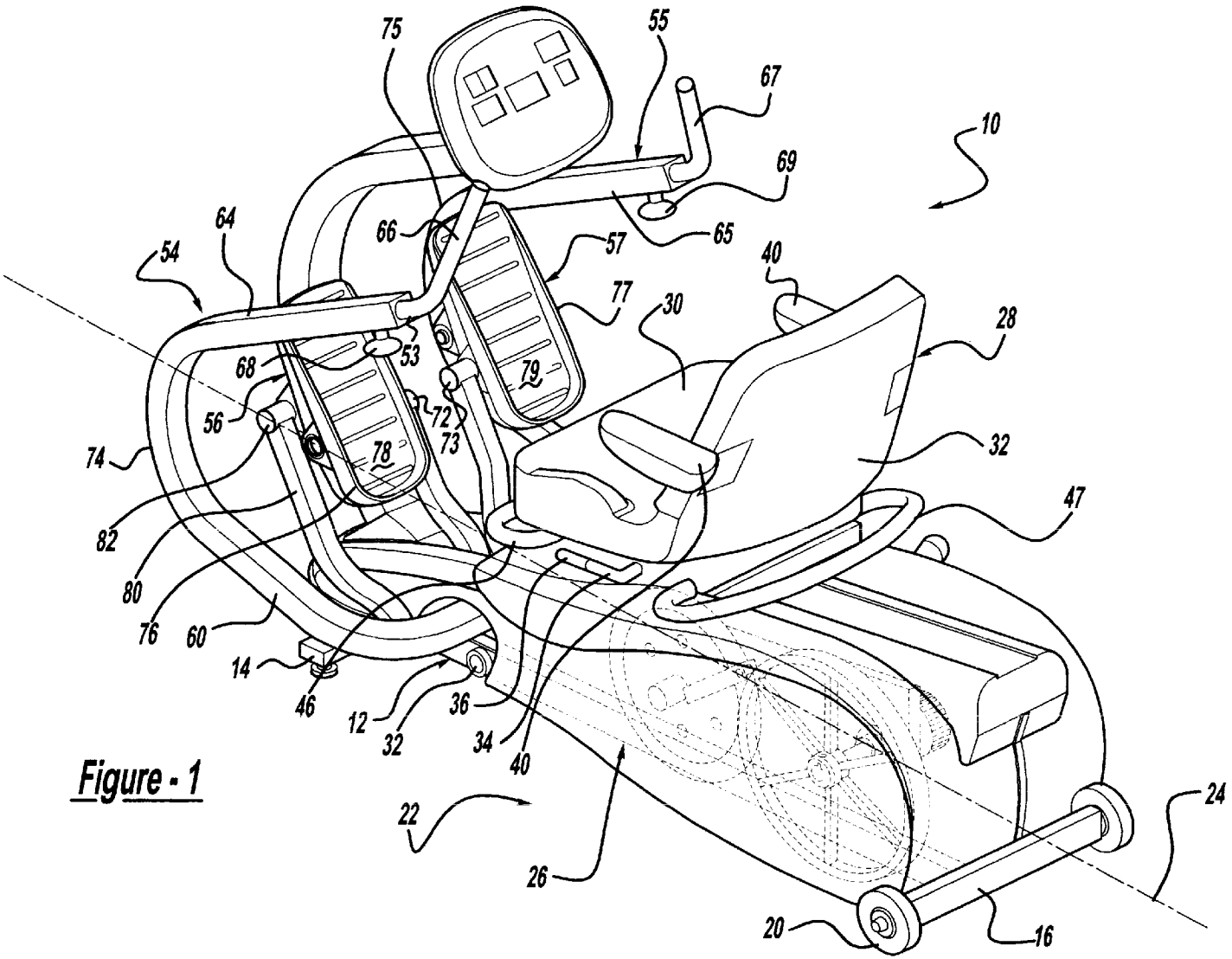
FIG. 1 is a perspective view of the present invention.

Referring now to the drawings, an apparatus embodying the principles of the present invention is illustrated in FIG. 1 and generally designated at 10. Generally the apparatus 10 is a physical therapy or exercise device which could be referred to as a total body, recumbent stepping machine.

The apparatus 10 is a total body exerciser since it strengthens or rehabilitates all of the major muscle groups while also providing for effective cardiovascular conditioning. The apparatus is recumbent since the patient or user is generally in a reclined position when it is being used. The apparatus 10 can be referred to as a stepper since it exercises the legs of the user through an oscillating or reciprocating movement of pedals 76 and 77 and through the offering of resistance to pushing of the pedals 76 and 77. While pushing resistance exercises the legs and lower body of the user, the exercising of the upper body and arms is through pulling or pushing resistance offered through a pair of handles 66 and 67.

Generally, the apparatus or exercise machine 10 of the present invention is comprised of a frame 12 which includes a front support 14 and a rear wheeled support 16, and a casing or housing 26 that encloses the resistance assembly as further discussed below. Generally the components of the resistance assembly are supported on the central portion of the frame 12 and are enclosed within the housing 26 that prevents inadvertent contact with the user or user's clothing during the use of the machine 10.

Figure 7:
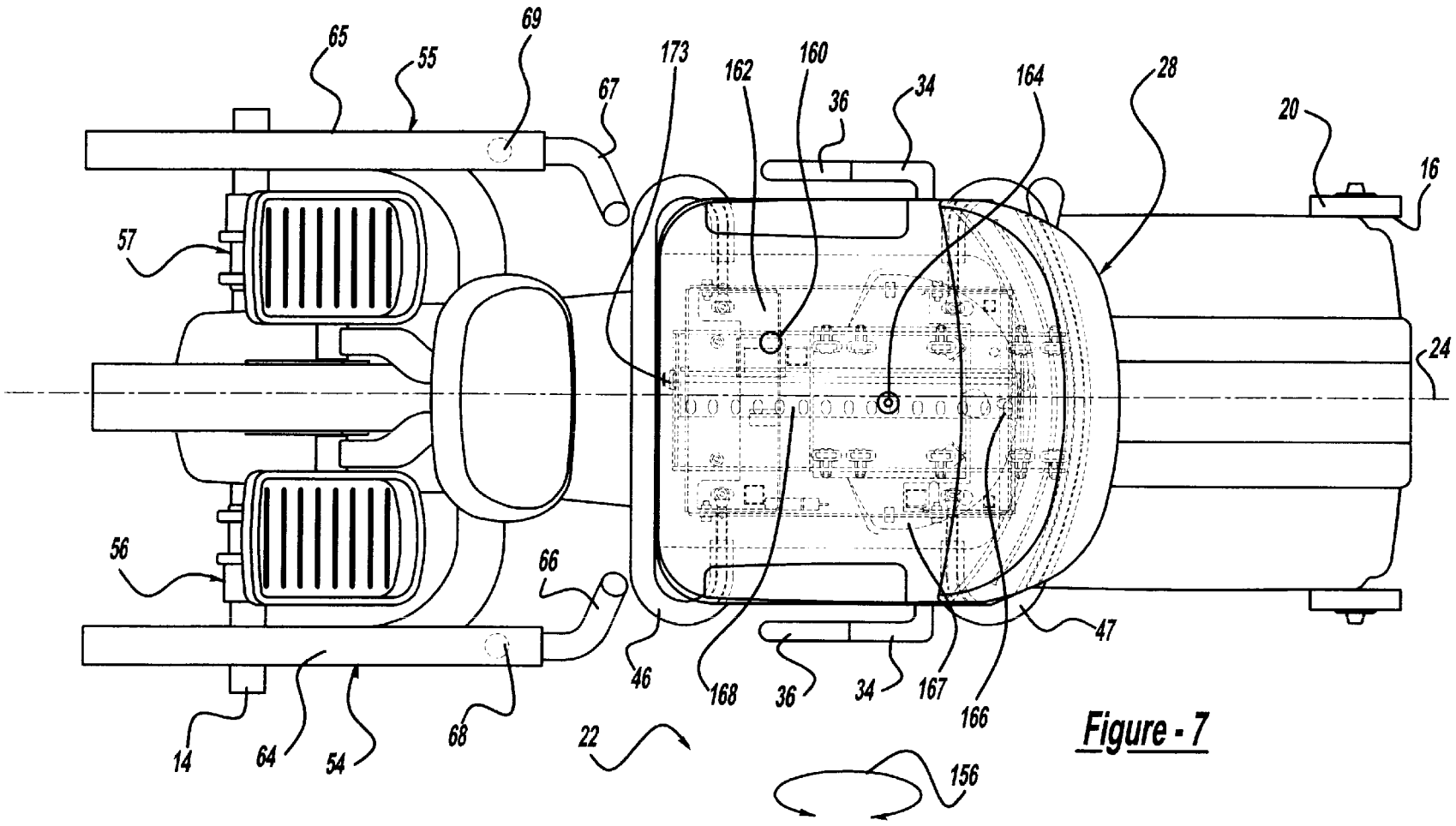
FIG. 7 is a plan view of the present invention.

Preferably the frame 12 is made from steel in various stock forms such as plate stock, angle stock or tubular stock. As seen in FIGS. 1 and 7, the wheeled rear support 16 and front support 14 define an H-section with the central portion of the frame 12 and are made of tube stock. The front support 14 is spaced from the rear support 16 generally along a central axis 24 which bisects the rear support 16. Rolling wheels 20 are provided on the ends of the rear support 16 for contact with the floor supporting the exercise machine 10. The floor is generally designated as 22 in the Figures.

Referring to FIG. 1, a seat 28, having a seat cushion 30 and a seat back 32, is adjustably mounted on the frame 12 for varied positioning along the central axis 24. This is accomplished by an adjustment mechanism. The adjustment mechanism can be of the kind outlined in U.S. Pat. No. 5,356,356 entitled "Recumbent Total Body Exerciser" which issued to Hildebrandt et al. On Oct. 18, 1994 and is incorporated by reference herein. The seat 28 is generally of the full bucket variety and is padded for the comfort of the user. Located toward the rear of the frame 12, the seat 28 is positioned so that the height of the seat cushion 30 approximates the height of a standard chair thereby inherently increasing the user's familiarity with the machine 10. Also, the slope along the top of the housing 26 allows the height of the seat 28 to be lowered as it is adjusted forward for shorter users and raised as it adjusted rearward for taller users. As seen in FIGS. 1 and 7, laterally outboard of the seat cushion are mounted a pair of stationary grab bars 34 having padded grips 36 so that the user has an alternate position for his hands when upper body conditioning is not desired. A pair of arm rests 40 are also coupled to the seat 28 to aid in the dismounting and mounting of the seat 28.

As described previously in the incorporated reference Hildebrandt et al., the seat 28 may be adjustably positioned along a central axis 24 for users of varying body dimensions. In a second embodiment, as seen in FIGS. 1, 7, and 8, the lever arm 46 is pivotally mounted to the seat 28 and is moved in the direction of arrow 152 to release and lock the seat into a fixed linear position along arrow 158. By lifting upwardly on the lever arm 46, the lever arm 46 will pivot about pivot point 48 forcing pin 160 onto seat release bracket 162. Seat release bracket 162 is coupled to a rectangular member 168 having holes throughout its length. As seat release bracket 162 is forced down in the direction of arrow 163 during the adjustment of the seat, rectangular member 168 will be pivoted upward about pivot 173 in the direction of arrow 165. This upward pivoting action of rectangular member 168 will release rectangular member 168 from fixed pins 169 attached to frame 12, which are normally coupled to holes in the rectangular member 168 to fix the position of the seat 28. The release of rectangular member 168 from fixed pins 169 allows the seat 28 to slide back and forth for adjustment purposes in the direction of arrow 158. While specific adjustment mechanisms have been specifically described in detail, it will be appreciated that numerous other types of adjustment mechanisms could be substituted for the mechanisms illustrated and discussed above. Alternate mechanisms are therefore deemed to be within the purview of this invention.

The seat 28 will also pivot to an outboard position to allow easy seating and unseating. The lever arm 47 is pivotally mounted to seat 28 and is moved in the direction of arrow 154 to release and lock the seat into a fixed position. By lifting upwardly on lever arm 47, a pin 166 is disengaged from a plate 167 on seat channel 172, enabling seat 28 to pivot about pivot point 164 in the direction of arrow 156. The seat 28 is positioned on the pivot 164 so that it may rotate and allow a user to sit in the seat 28 while the seat 28 is perpendicular to the length of exercise machine 10 and then rotate into position to use the exercise machine 10. The arm rests 40 provide an area for the user to steady himself as he mounts and dismounts the seat 28. To prevent the user from inadvertently sliding the seat 28 in the direction of arrow 158 while the seat 28 is pivoted from the operating position, a built in safety feature is included the seat 28. While pivoting the seat 28, the pin 160 is pivoted away from seat release bracket 162, making it impossible for seat release bracket 162 to pivot the rectangular member 168. Since the rectangular member 168 cannot be moved during the pivoting of seat 28 about pivot point 164, the rectangular member 168 will not release from fixed pins 169 and allow movement of the seat 28 along arrow 158. This prevents the seat 28 from accidentally sliding while a user is pivoting or mounting the seat 28 in its outboard position.

As seen in FIGS. 1, 2, 5, 6, and 7, located forward of the seat 28 are a pair of arm assemblies 54 and 55 and a pair of leg assemblies 56 and 57, all of which are configured to undergo oscillating or reciprocating movement about a pivot axis 32. The arm assemblies 54 and 55 include lower levers 60 and 61 which extend forward and upward from the pivot axis 32 to elbows 74 and 75. Thereafter, the arm assemblies 54 and 55 extend rearward and upward toward the seat 28 along upper extensions 64 and 65. Handles 66 and 67 are slidably received in the upper extension 64 and 65 and are provided with keyway slots 53 so as to prevent their rotation relative to the upper extensions 64 and 65. The handles 66 and 67 can be adjusted in length and for this reason locking levers 68 and 69 are provided on the upper extensions 64 and 65 to secure them at the desired length. The ends of the handles 66 and 67 are generally bent upward and inward relative to the remainder of the handles 66 and 67 and are provided with padded grips.

As seen in FIG. 1, the leg assemblies 56 and 57 similarly extend upward from the pivot axis 32 along levers 72 and 73. The pedals 76 and 77 are preferably secured to the levers 72 and 73 and linkages 80 and 81 in a pivotable manner, but could alternatively be rigidly secured thereto. The levers 72 and 73 and linkages 80 and 81 create a four bar linkage which keeps the angle of the pedals 76 and 77, with reference to the user, in a biomechanically correct position throughout the length of stroke. The linkages 80 and 81 pivot at pivot points 82 and 83 coupled to the pedals 76 and 77 and pivot at pivot point 85 coupled to the frame 12. The pedals 76 and 77 are provided with heel cups 78 and 79 at their lower ends so that the foot of a user will not inadvertently slip off the deck portion of the pedals 76 and 77. The geometry and orientation of the seat 28, handles 66 and 67, the pedals 76 and 77 and the pivot axis 32 are set relative to one another so that regardless of the size of the person using the machine 10, once properly adjusted, the resulting movement and form during upper and lower body conditioning is biomechanically correct and efficient. This is particularly important in the physical therapy setting where proper form can result in quicker and safer recovery and rehabilitation.

Figure 2:
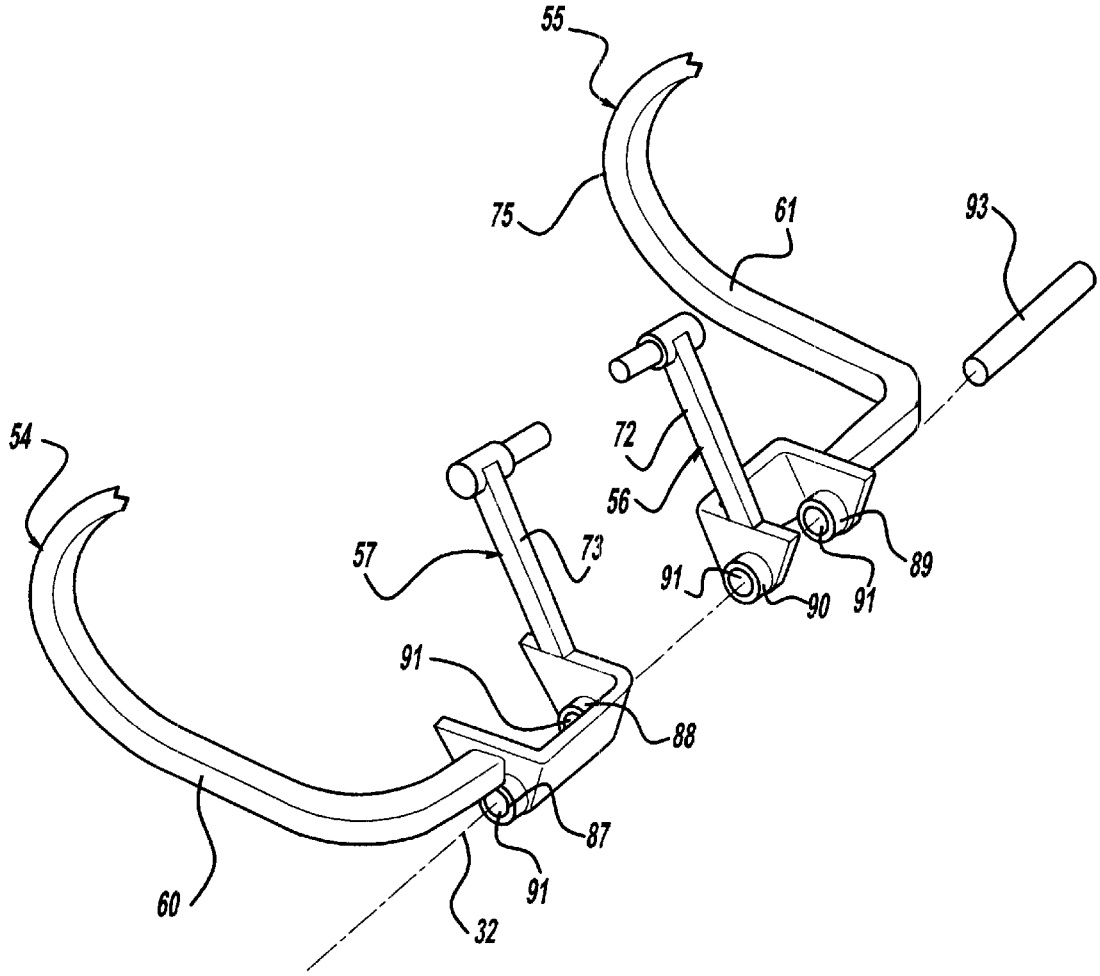
FIG. 2 is a perspective view of the arm and leg assemblies.

Referring to FIG. 2, the connection of the arm assemblies 54 and 55 and leg assemblies 56 and 57 is illustrated. Arm assembly 54 is rigidly coupled to leg assembly 57 and arm assembly 55 is rigidly coupled to leg assembly 56 for contralateral motion about pivot axis 32. This rigid coupling will cause arm assembly 54 and leg assembly 57 and arm assembly 55 and leg assembly 56 to move together. The arm and leg assemblies are further coupled together to operate together. Arm assembly 54 and leg assembly 57 are coupled to circular brackets 87 and 88, and arm assembly 55 and leg assembly 56 are coupled to circular brackets 89 and 90. A rod 93 mounted to the frame 12 is inserted through brackets 87, 88, 89, and 90 to couple the arm and leg assemblies together along pivot axis 32. Plastic bushings 91 are inserted in brackets 87, 88, 89, and 90 to provide lubrication with rod 93 during operation.

Figure 5:
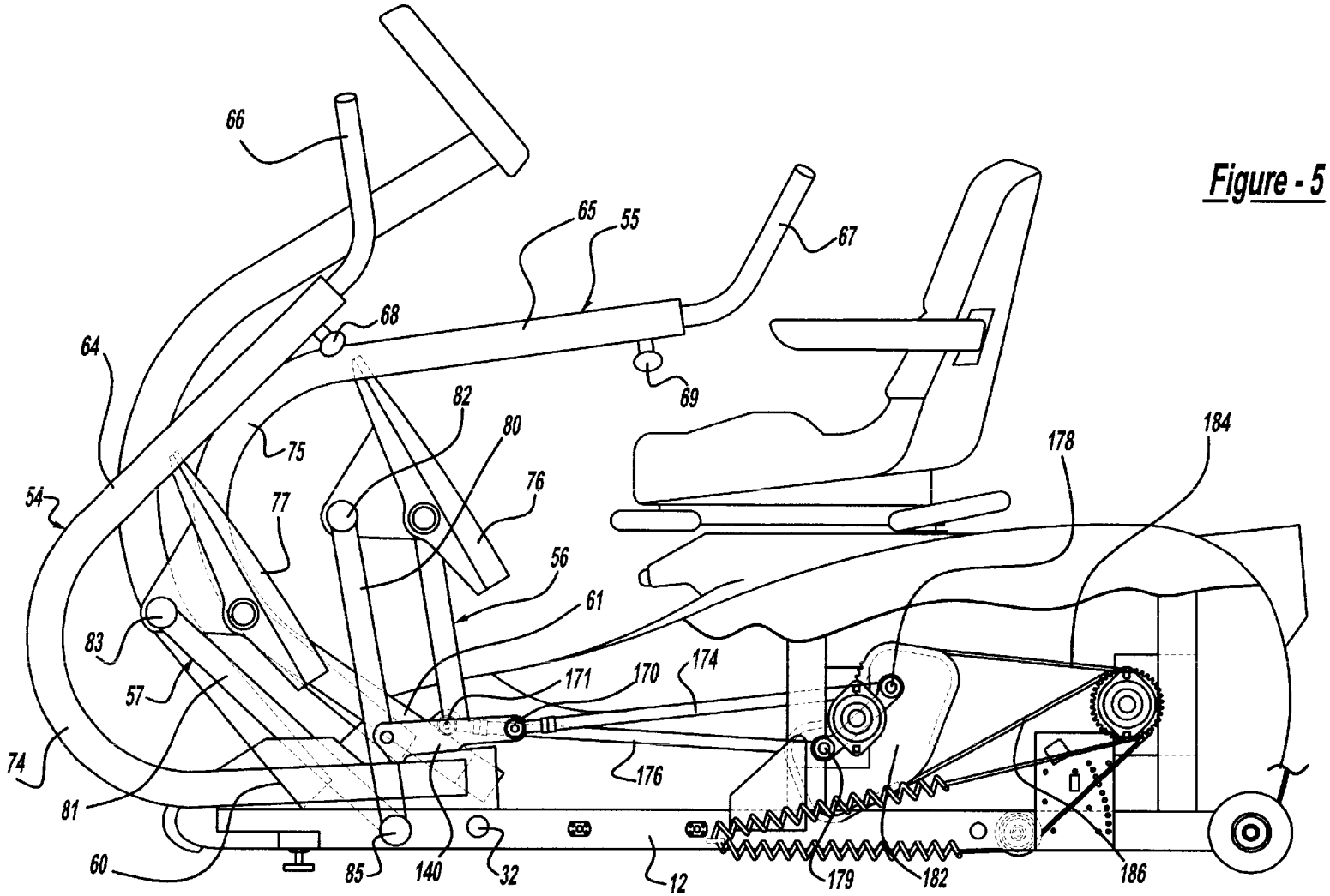
FIGS. 5 and 6 are side elevations views with portions broken away from the apparatus.
Figure 6:
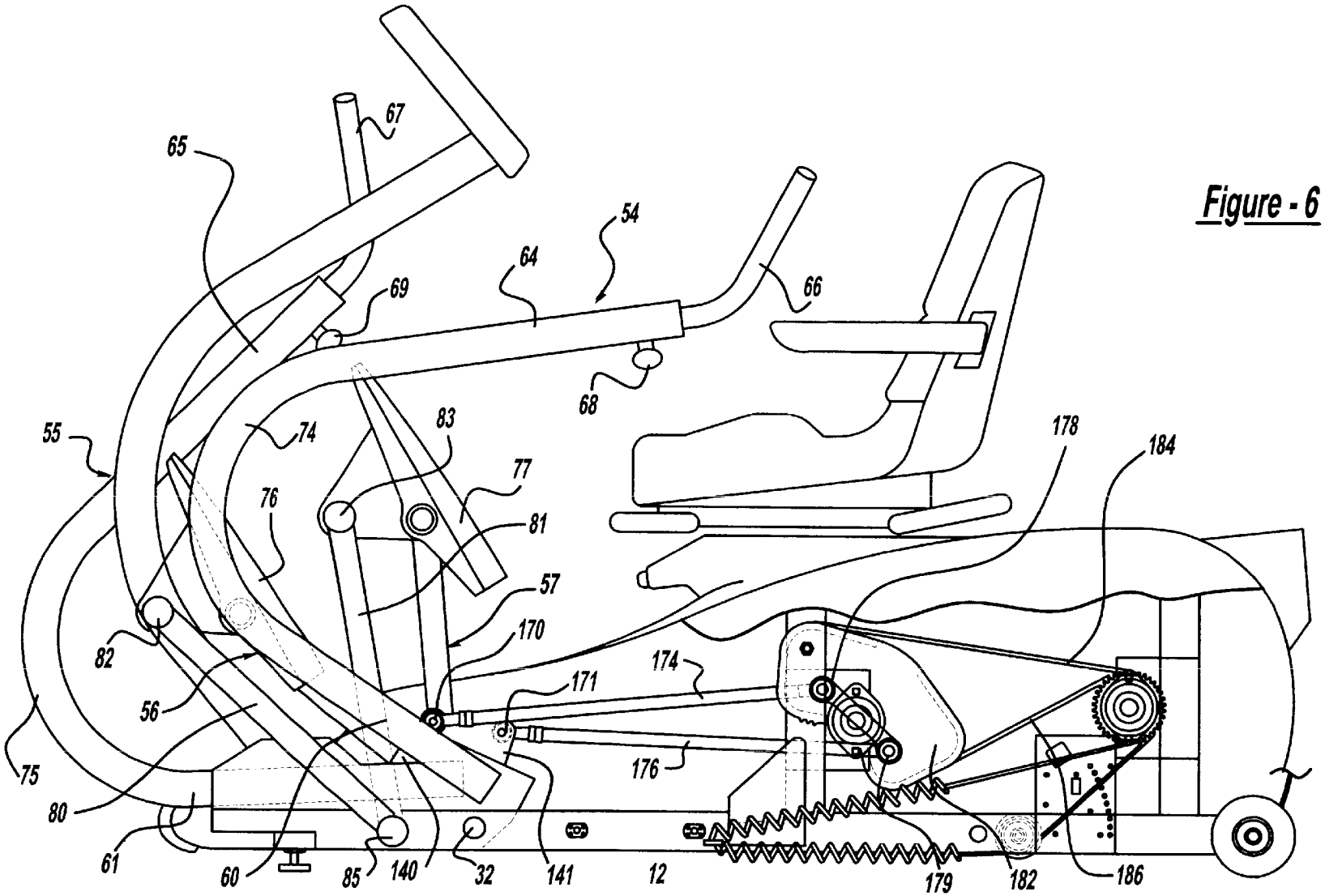

As seen in FIGS. 5 and 6, the movement of one set of arm and leg assemblies is tied to the movement of the other set of arm and leg assemblies so that movement of one induces a counter movement in the other. In other words, as one set of arm and leg assemblies moves forward the other set moves backward. To coordinate this movement arm assembly 54 and leg assembly 57 are coupled to member 140 and arm assembly 55 and leg assembly 56 are coupled to member 141. Members 140 and 141 are then coupled to pivot points 170 and 171 which are further coupled to linkages 174 and 176 which transfer movement to a cam 182 via pivot points 178 and 179. As the arm and leg assemblies move back and forth the cam 182 will move back and forth. The cam 182 has been designed to keep resistance constant throughout its range of movement, removing any jerking or progressive resistance for smoother operation. The shape of the cam 182 compensates for the change in the mechanical load placed on pivot points 178 and 179 by the movement of the linkages 174 and 176 to keep the resistance felt by the user constant. As the linkages 174 and 176 are moved by the user, the mechanical lever formed on pivot points 178 and 179 will lengthen and shorten, varying the amount of force or torque exerted by the user onto the pivot points 178 and 179. The cam 182 will compensate for this change in torque by varying the torque it exerts on belts 184 and 186 which are coupled to a resistance device.

Figure 3:
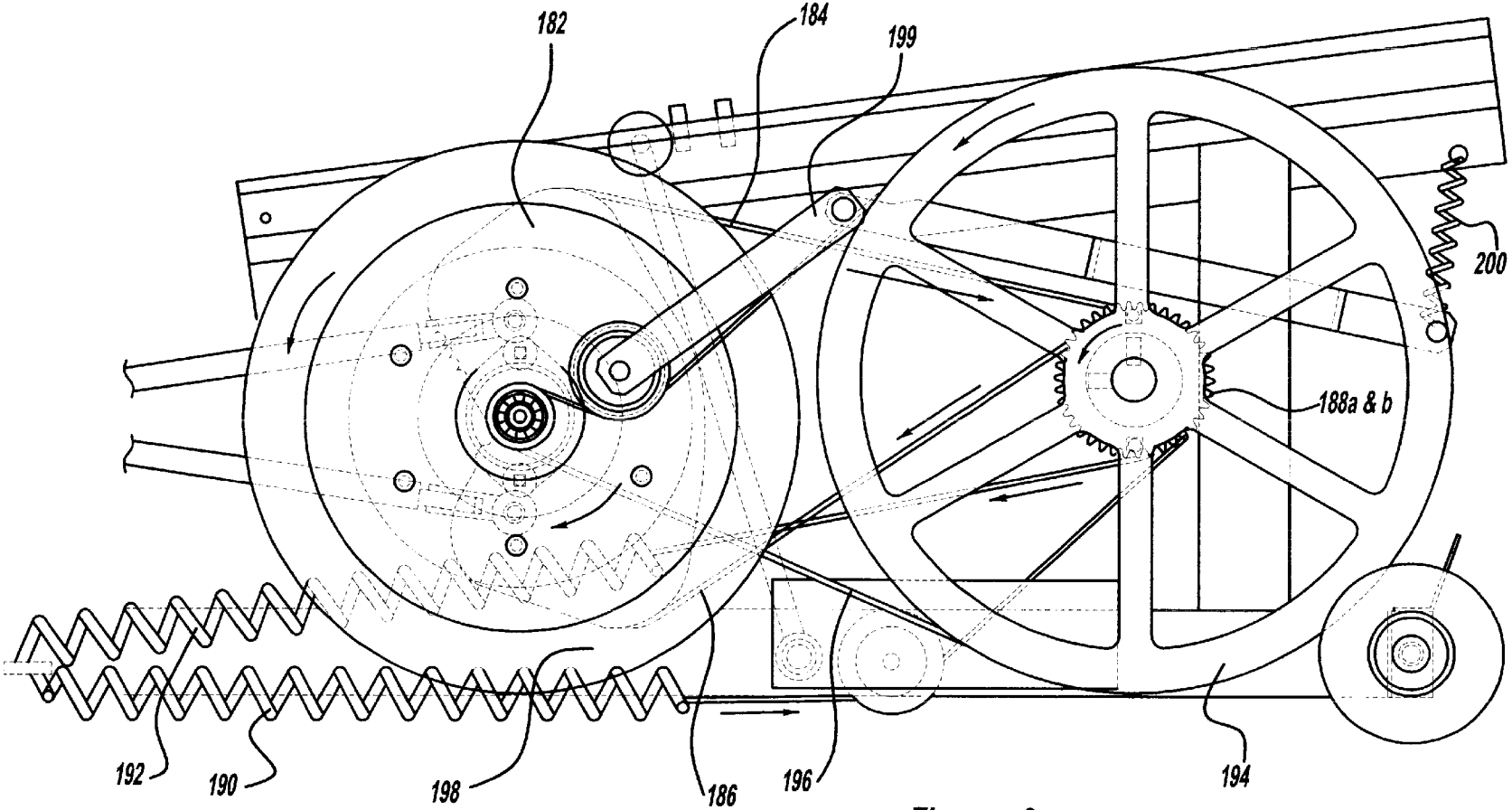
FIG. 3 is a diagrammatic view of the drive transfer mechanism of the present invention.

Referring to FIG. 3, belt 184 is coupled to generally the top portion of the cam 182 and belt 186 is coupled to generally the bottom portion of the cam 182 so that when the cam 182 rotates one of the belts 184 or 186 will have a pulling force exerted on it. The belts 184 and 186 are further linked to one way rotary clutches 188*a* and 188*b* which follow the motion of the belts 184 and 186. The clutches 188*a* and 188*b* will exert resistance in only one direction and will ratchet back and forth with the belts 184 and 186. To maintain tension on the belts 184 and 186, springs 190 and 192 are coupled to the end of the belts 184 and 186 and fixed to the frame 12 of the apparatus 10. The belts 184 and 186 may be a timing belt, a v-groove belt, or any other type of belt used to transfer force.

The clutches 188*a* and 188*b* will rotate and exert force in a counter clockwise motion and ratchet in a clockwise motion as the cam 182 is moved back and forth pulling belts 184 and 186. The clutches 188*a* and 188*b* are coupled to a pulley 194, having an increased diameter, which is rotated by the counterclockwise force exerted by the clutches 188*a* and 188*b*. The pulley 194 is coupled via a belt 196 to an Eddy Current Disk (hereinafter "ECD") 198 which provides rotational resistance for the user. The belt 196 is similar to the previously mentioned belts 184 and 186. A belt tensioner 199 tightens the belt via a spring 200 onto the pulley 194 and ECD 198 to prevent belt slippage.

Figure 4:
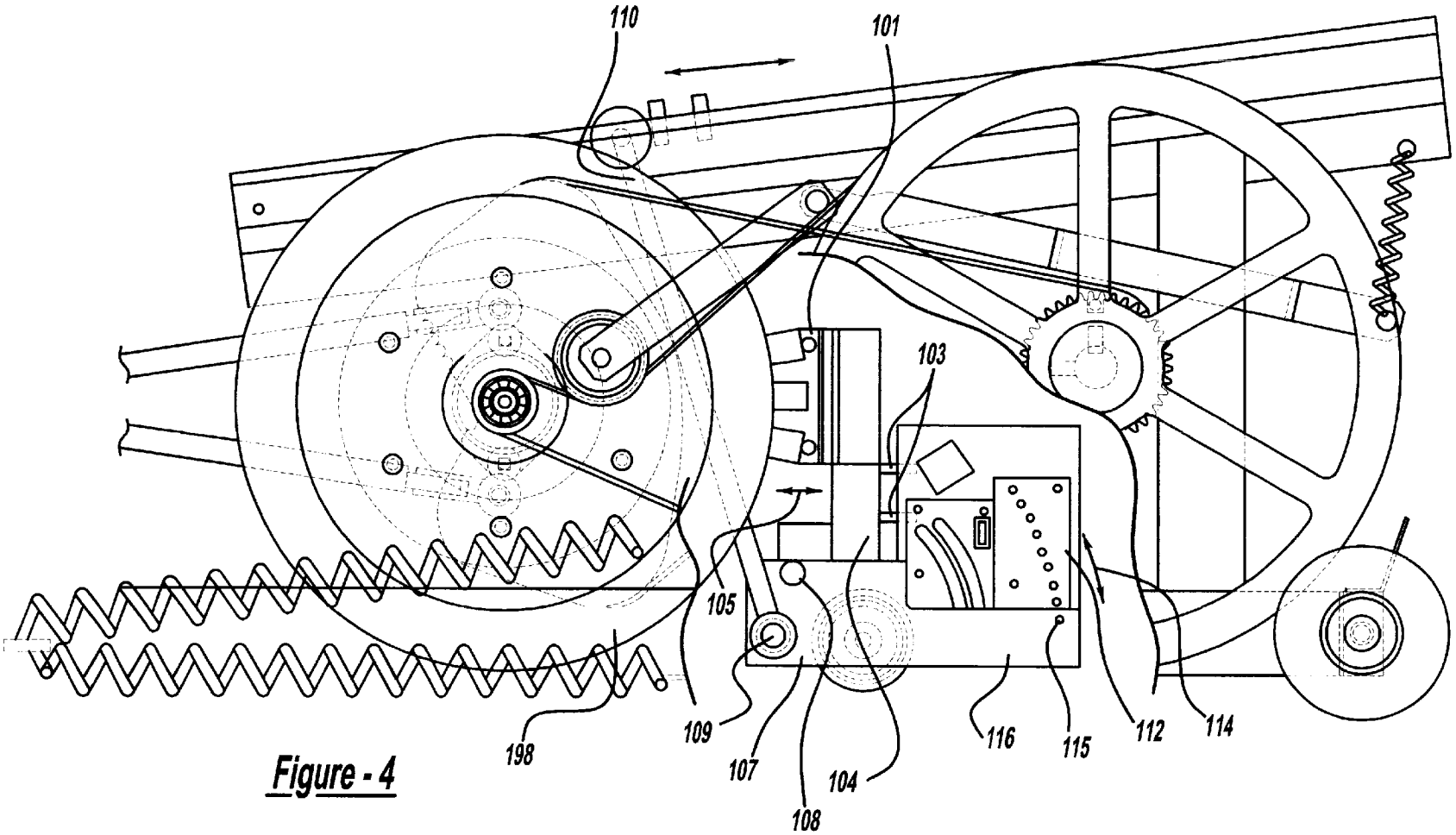
FIG. 4 is a diagrammatic view of the resistant mechanism of the present invention.

Referring to FIG. 4, the ECD 198 resistance is controlled by a magnet array or singular magnet 101 coupled to a variable mounting. The magnet array 101 may be moved in a linear fashion closer to or farther away from the ECD 198, varying the magnetic coupling between the ECD 198 and magnet array 101 and thereby varying the rotational resistance. The magnet array 101 is coupled to an upright member 104 which slides along linear bearings 103 in the direction of arrow 105. The upright member 104 is further coupled to a rotary member 107 through pivot point 108. A lever 110 operated by a user rotates rotary member 107 on pivot point 109 which in turn exerts a linear force on upright member 104, forcing upright member 104 to move in the direction of arrow 105. The position of upright member 104 is fixed by the end 116 of rotary member 107, as it rotates in the direction of arrow 114, by a pin 115 mounted in end 116 coupled to the array of holes in the coupling mechanism 112. The adjustment of the magnet array 101 can thus be done with proportional increases in a linear fashion and discrete steps in the positioning of the magnet array 101, aiding in the reproduction and mapping of resistance for a user. The position of the magnet array 101 is input to a control system 150 by an electrical circuit to calculate user work information. The electrical circuit comprises a wiper system coupled to end 116 and a series of conductive sections coupled to the frame 12. As the end 116 varies its position, the wiper will contact alternate conductive sections which instruct the control system 150 on the location of the magnet array 101.

The machine 10 of the present invention is provided with an onboard control system 150, as seen in FIG. 9, which includes a display panel 120. The control system 150 can be programmed so that it will provide information to the user or to the physical therapist with respect to work output, calories consumed, rpm level, pace information, workout duration, etc. As such the control system 150 is connected so as to monitor the rpms of the ECD 198 as well as the steps from the handles 66 and 67 pedals 76 and 77. The control system 150 can be powered by batteries or directly off of the resistance assembly ECD 198.

Additional benefits and advantages of the present invention will become apparent to those skilled in the art to which this invention relates from the subsequent description of the preferred embodiments and the appended claims taken in conjunction with the drawings.

We claim:

1. An exercise machine having a frame, a seat, and a seat positioning mechanism comprising:

a linear adjustment mechanism for connecting the seat to the frame such that the seat is movable in a linear fashion along the length of the frame;

rotary mechanism to pivot the seat from a use position to a boarding position permitting a user to easily mount and dismount the seat;

wherein as the seat is pivoted from said use position to said boarding position said linear adjustment mechanism is disabled, therby preventing movement of the seat in the linear fashion.

2. An exercise machine comprising:

a frame;

a seat coupled to said frame;

a first member fixed to said frame;

a second member connected to said seat and moveable between an engaged position and a disengaged position with said first member whereby in said disengaged position said seat is movable with respect to said frame in a linear direction;

a first arm coupled to said second member such that said first arm engages and disengages said second member;

a third member fixed to said frame;

a fourth member connected to said seat and moveable between an engaged position and a disengaged position with said third member, whereby when the fourth member is in said disengaged position said seat is rotatable with respect to said frame between a use position and a boarding position;

a second arm coupled to said fourth member such that said second arm engages and disengages said fourth member;

whereby when said seat is not in said use position, said first arm is decoupled from said second member.

3. The exercise machine of claim 2 wherein said first member comprises at least one pin.

4. The exercise machine of claim 2 wherein said second member comprises a plate having defining at least one hole adapted to engage and disengage with said first member.

5. The exercise machine of claim 2 wherein said third member comprises a plate having at least one hole.

6. The exercise machine of claim 2 wherein said fourth member comprises at least one pin adapted to engage and disengage with said third member.

7. The exercise machine of claim 2 wherein said first arm comprises a lever coupled to said second member and adapted to engage said second member with said first member and thereby restrict linear motion of said seat along said frame.

8. The exercise machine of claim 2 wherein said first arm comprises a lever coupled to said second member and adapted to disengage said second member with said first member and thereby permit linear motion of said seat along said frame.

9. The exercise machine of claim 2 wherein said second arm comprises a lever coupled to said fourth member and adapted to disengage said fourth member with said third member and thereby permit rotational motion of said seat about said frame between a use position and a boarding position.

10. The exercise machine of claim 2 wherein said second arm comprises a lever coupled to said fourth member and adapted to engage said fourth member with said third member and thereby restrict rotational motion of said seat about said frame between a use position and a boarding position.

11. The exercise machine of claim 2 wherein as said second arm disengages said fourth member from said third member, said seat is rotatable from a use position and a boarding position, and said first arm is decoupled from said second member thereby prohibiting linear motion of said seat along said frame.

12. An exercise machine having a frame and a seat, the exercise machine comprising:

means for connecting a seat to a frame of the exercise machine such that the seat is movable in a linear fashion along the length of the exercise machine;

means for pivoting the seat from use position permitting use of the exercise machine to boarding position permitting a user to mount and dismount the seat; and means whereby as the seat is pivoted from said use position to said boarding position the means for connecting the seat to the frame is thereby disabled from moving the seat in a linear fashion.

* * * * *

UNITED STATES PATENT AND TRADEMARK OFFICE

CERTIFICATE OF CORRECTION

PATENT NO. : 6,666,799 B2 
DATED : December 23, 2003
INVENTOR(S) : Mark D. Hildebrandt, Todd A. Sutton, and Steve W. Sarns It is certified that error appears in the above-identified patent and that said Letters Patent is hereby corrected as shown below:

Column 8,
Line 57, before "rotary", insert -- a --.
Line 58, before "mount", delete "easily".

Signed and Sealed this

Eighth Day of June, 2004

JON W. DUDAS
*Acting Director of the United States Patent and Trademark Office*